US011235219B2

(12) United States Patent
Perez

(10) Patent No.: US 11,235,219 B2
(45) Date of Patent: Feb. 1, 2022

(54) SELF-PROPELLED WATERBORNE WAVE RIDING SYSTEM

(71) Applicant: Eliu Perez, Kissimmee, FL (US)

(72) Inventor: Eliu Perez, Kissimmee, FL (US)

( * ) Notice: Subject to any disclaimer, the term of this patent is extended or adjusted under 35 U.S.C. 154(b) by 0 days.

(21) Appl. No.: 17/185,004

(22) Filed: Feb. 25, 2021

(65) Prior Publication Data

US 2021/0268355 A1 Sep. 2, 2021

Related U.S. Application Data

(60) Provisional application No. 62/983,314, filed on Feb. 28, 2020.

(51) Int. Cl.

| | |
|---|---|
| ***B63B 1/00*** | (2006.01) |
| ***A63B 69/00*** | (2006.01) |
| ***B63B 1/12*** | (2006.01) |
| ***A63G 31/00*** | (2006.01) |

(52) U.S. Cl.

CPC ..... *A63B 69/0093* (2013.01); *A63G 31/007* (2013.01); *B63B 1/125* (2013.01); *B63B 2001/126* (2013.01)

(58) Field of Classification Search

CPC ..... A63G 31/007; B63B 2001/126; B63B 1/125; B63B 34/70; B63B 35/44; A63B 69/0093; A63B 69/125; E04H 4/0006; E02B 3/062

USPC ..... 405/79, 80, 75, 108, 107, 86, 21–25, 31; 4/491; 472/13

See application file for complete search history.

(56) References Cited

U.S. PATENT DOCUMENTS

| | | | | |
|---|---|---|---|---|
| 3,085,404 A * | 4/1963 | Smith | E02B 3/06 | 405/26 |
| 3,316,873 A * | 5/1967 | Dismukes | B63B 1/24 | 114/39.24 |
| 3,802,697 A * | 4/1974 | Le Mehaute | A63G 3/02 | 482/51 |
| 4,322,294 A * | 3/1982 | Price | E02B 15/104 | 210/242.3 |
| 5,219,315 A * | 6/1993 | Fuller | A63G 3/00 | 348/124 |
| 5,236,280 A * | 8/1993 | Lochtefeld | E04H 4/0006 | 405/79 |

(Continued)

OTHER PUBLICATIONS

Royal Caribbean; Surf's Up on Royal Caribbean's FlowRider; https://www.youtube.com/watch?v=MA_HV1nfuAc) (Year: 2019).*

*Primary Examiner* — Edwin J Toledo-Duran

(74) *Attorney, Agent, or Firm* — Jason T. Daniel, Esq.; Daniel Law Offices, P.A.

(57) ABSTRACT

A self-propelled waterborne wave riding system includes a vessel having at least one motor and control system for navigating and propelling the vessel along a body of water. A rider section is located along the top of the vessel and includes a lower platform at the front of the vessel, an upper platform at the back of the vessel, and an elongated angled ride surface that extends between the upper and lower platforms. A pump system is provided along the vessel and includes an impeller assembly that is mechanically coupled to an inboard motor and a water pipe. Water received by the impeller is directed through the water pipe to a horizontally oriented nozzle in the lower platform which pushes the water over the ride surface. Openings in the upper platform return the used water into the body of water.

16 Claims, 3 Drawing Sheets

(56) References Cited

U.S. PATENT DOCUMENTS

| | | | | |
|---|---|---|---|---|
| 5,401,117 | A * | 3/1995 | Lochtefeld | A63B 69/0093 4/491 |
| 7,101,475 | B1 * | 9/2006 | Maaske | E04H 4/1263 210/106 |
| 7,789,804 | B1 * | 9/2010 | Phillips | A63B 69/18 482/35 |
| 9,463,390 | B2 * | 10/2016 | Vicente | A63G 31/007 |
| 9,895,619 | B2 * | 2/2018 | Johnson, Jr | A63G 31/00 |
| 2001/0029136 | A1 * | 10/2001 | Zapatero Denegri | B63B 32/70 441/65 |
| 2002/0180155 | A1 * | 12/2002 | Lochtefeld | A63J 19/006 273/441 |
| 2003/0017769 | A1 * | 1/2003 | Rosen | B63H 16/08 441/76 |
| 2003/0119592 | A1 * | 6/2003 | Lochtefeld | E04H 4/0006 472/117 |
| 2005/0258267 | A1 * | 11/2005 | Potter | A63G 31/00 239/16 |
| 2007/0186338 | A1 * | 8/2007 | Sauerbier | B63B 34/00 4/491 |
| 2008/0088132 | A1 * | 4/2008 | Laube von Laubenfels | F03B 13/14 290/53 |
| 2012/0201605 | A1 * | 8/2012 | Hill | A63H 33/42 405/79 |
| 2015/0119155 | A1 * | 4/2015 | Vicente | A63G 21/18 472/128 |
| 2016/0199744 | A1 * | 7/2016 | McCarthy | E04H 4/12 472/128 |
| 2017/0136373 | A1 * | 5/2017 | Vicente | A63G 21/18 |
| 2019/0366182 | A1 * | 12/2019 | Watson | F15D 1/0065 |

* cited by examiner

SELF-PROPELLED WATERBORNE WAVE RIDING SYSTEM

CROSS-REFERENCE TO RELATED APPLICATIONS

This application claims the benefit of U.S. application Ser. No. 62/983,314 filed on Feb. 28, 2020, the contents of which are incorporated herein by reference.

TECHNICAL FIELD

The present invention relates generally to water rides, and more particularly to a waterborne wave riding system for transport and use at locations along navigable waterways.

BACKGROUND

The statements in this section merely provide background information related to the present disclosure and may not constitute prior art.

Wave riding attractions are becoming increasingly popular at many waterparks and other such locations. Unfortunately, due to the large size of the riding area, pump assembly and water storage tanks, these attractions are space intensive and are not capable of being quickly or easily transported from one location to another. As such, most of these systems are permanently installed at locations for ongoing use.

Currently, there are no shortage of beach and waterfront establishments such as hotels, restaurants, marinas, and bars, for example, that attract tourists and guests with special events and activities. Owing to the high price of waterfront real-estate, space at these locations is at a premium, therefore it is not uncommon for such locations to install floating attractions. Several of the most common types of floating attractions include floating obstacle courses, floats, kayaks, sailboats, and jet skis, among others, for their guests to enjoy. To this end, such locations are often seeking new attractions for guest use in order increase attendance, without occupying the valuable waterfront land.

Accordingly, it would be beneficial to provide a self-propelled waterborne wave riding attraction that can be utilized by any number of different waterfront locations having access to navigable waterways, so as to overcome the drawbacks described above.

SUMMARY OF THE INVENTION

The present invention is directed to a self-propelled waterborne wave riding system. One embodiment of the present invention can include a vessel having a central hull, and a pair of outboard hulls. The vessel can include one or more motors and control system for navigating and propelling the vessel along a body of water. A support structure can be positioned along the top surface of the vessel for supporting a rider section.

In one embodiment, the rider section can include a lower platform that is positioned along the front of the vessel, an upper platform that is positioned along the back of the vessel, and an elongated angled ride surface that extends between the upper and lower platforms. The ride surface can be constructed from a single sheet of vinyl membrane having padded wall sections along either side.

In one embodiment, a pump system can be provided along the vessel. The pump system can include an impeller assembly that is mechanically coupled to an inboard motor and a water pipe. Water received by the impeller is directed through the water pipe to a horizontally oriented nozzle in the lower platform which pushes the water over the ride surface. Openings in the upper platform return the used water into the body of water.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, a "unit" means a series of identified physical components which are linked together and/or function together to perform a specified function.

Figure 1:
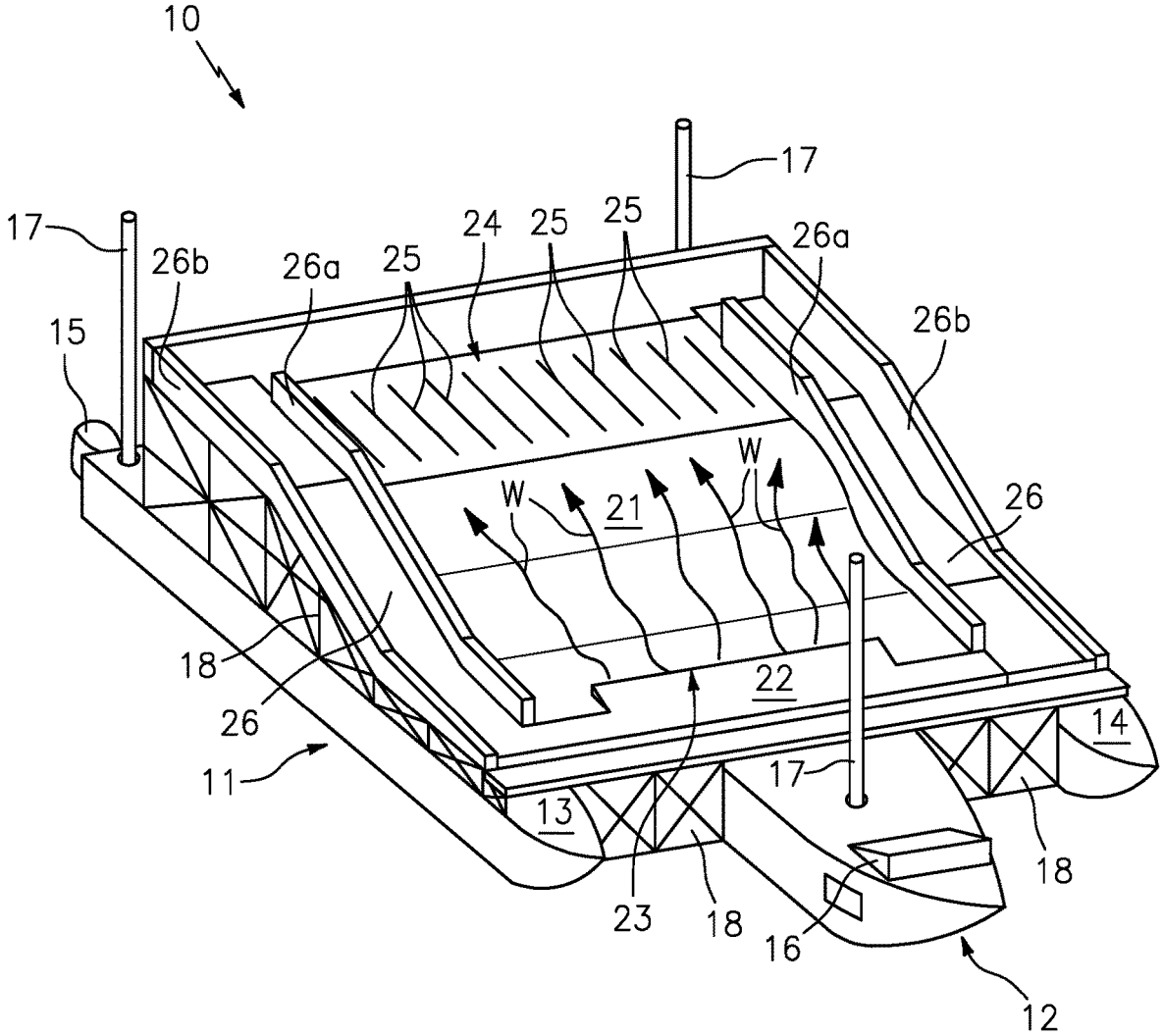
FIG. 1 is a perspective view of the self-propelled waterborne wave riding system, in accordance with one embodiment of the invention.
Figure 2:
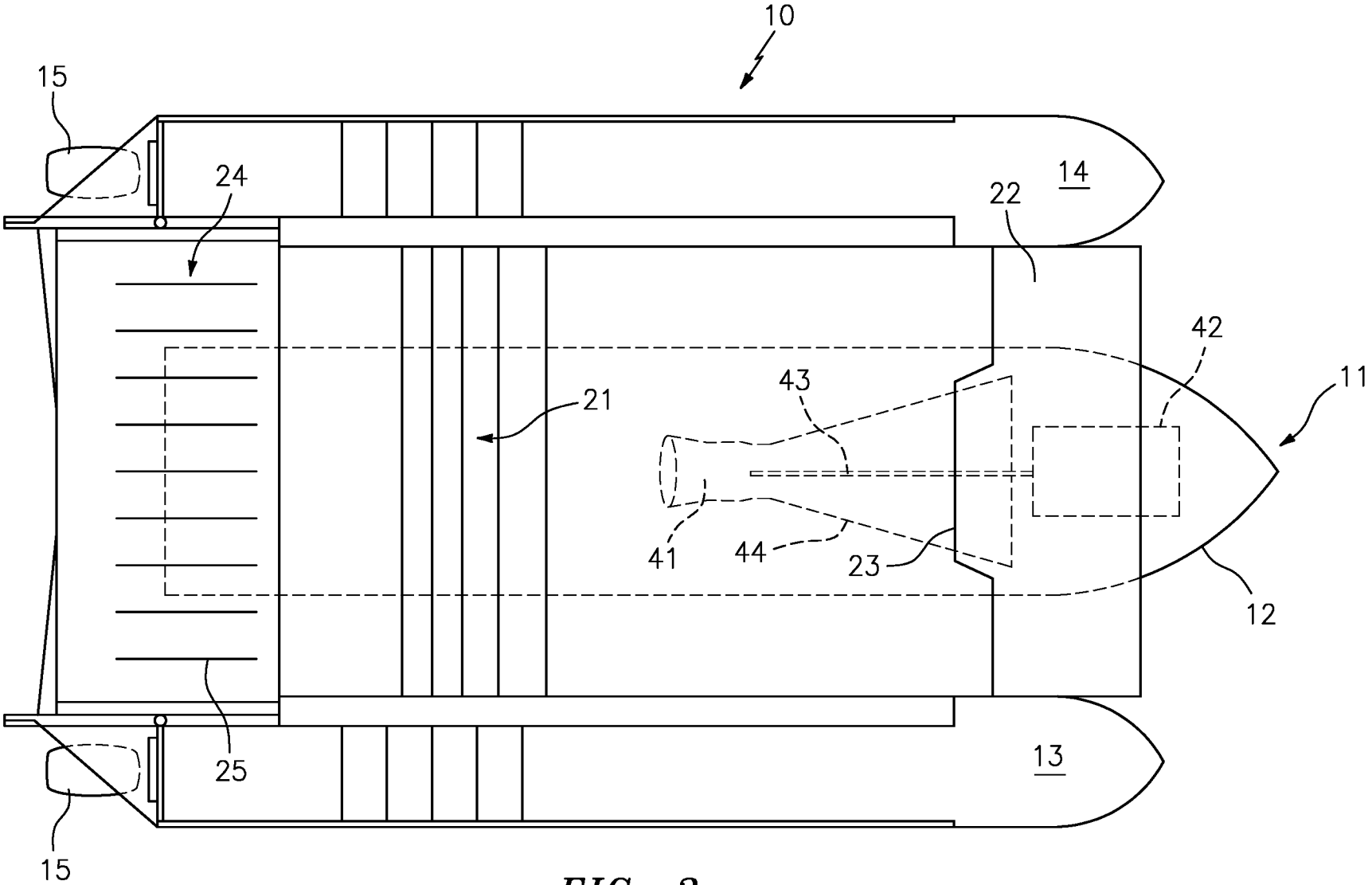
FIG. 2 is a top view of the self-propelled waterborne wave riding system, in accordance with one embodiment of the invention.
Figure 3:
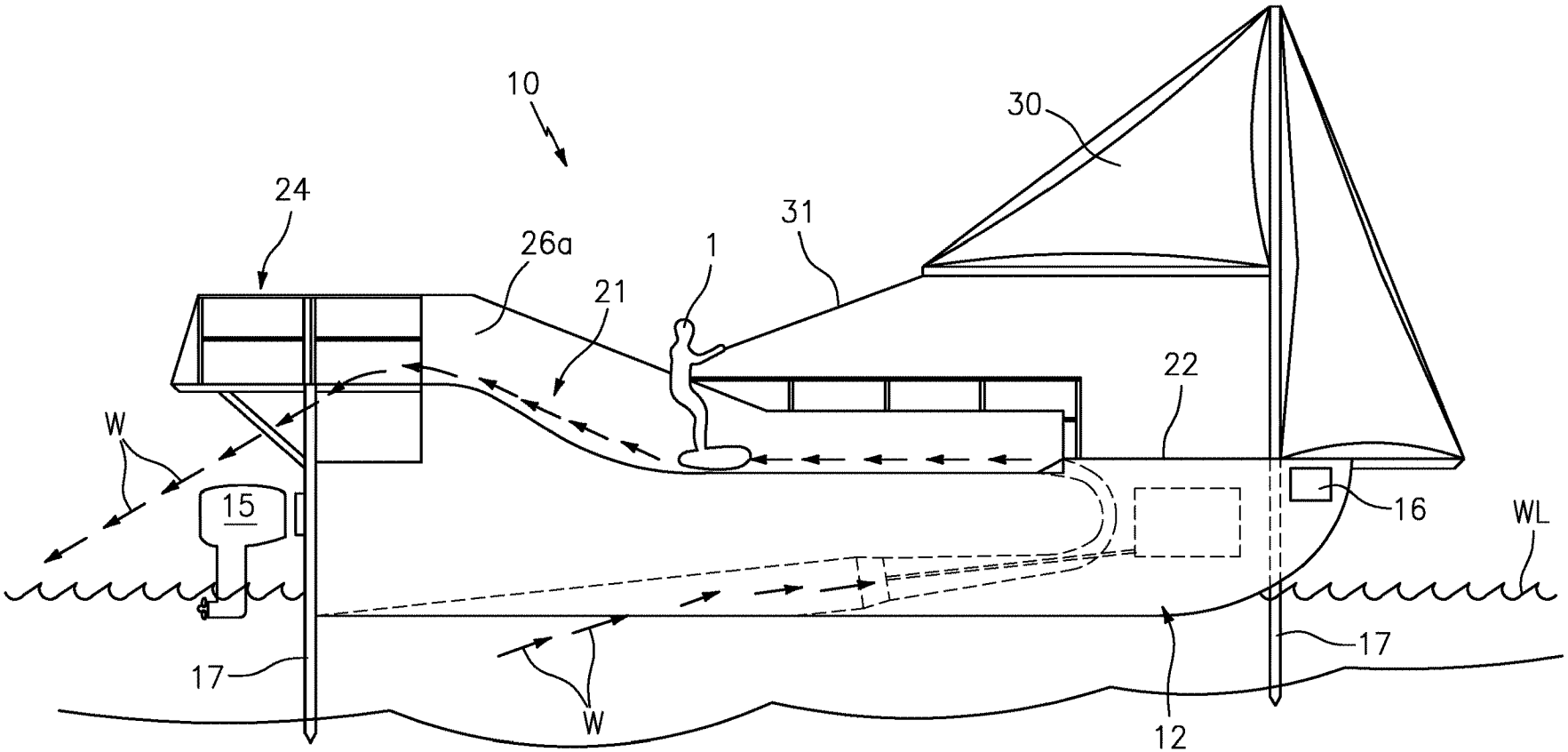
FIG. 3 is a side cutout view of the self-propelled waterborne wave riding system, in accordance with one embodiment of the invention.

FIGS. 1-3 illustrate one embodiment of a self-propelled waterborne wave riding system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in the drawings, the system 10 can include, essentially, a self-propelled vessel, having a support platform, a rider section and a pump system.

As shown best at FIG. 1, one embodiment of the vessel 11 can comprise a tri-hull boat having a central hull 12 positioned between two outboard hulls 13 and 14. In the illustrated embodiment, each of the outboard hulls include an outboard motor 15 thereon; however other embodiments are contemplated wherein different propulsion systems are provided. In one embodiment, the vessel 11 can be a factory-built tri-hull boat having all of the expected vessel operational components (e.g., steering, propulsion, navigation, etc.) positioned within a centrally located cockpit 16, for example.

Of course, other embodiments are contemplated wherein each of the hulls are individually constructed and joined together at a time after original manufacture. In either case, it is preferred that each of the hulls can include a substantially identical length, and that the central hull 12 include a width that is approximately 1.5 to 2 times wider than the outboard hulls. Such a feature functioning to provide maximum stability during both transportation of the vessel itself, and during ride operation.

Tri-hull motorized vessels and the respective components for operation of the same are well known in the art, and each of the expected components would be found on the vessel herein described in order to ensure safe and legal operation of the same on any navigable waterway. Although described above with regard to a tri-hull vessel, this is for illustrative purposes only. To this end, the vessel 11 can include any type of boat, barge or floating platform capable of traversing navigable waterways.

In the preferred embodiment, each of the hulls can include at least one vertical anchor system having an elongated shaft 17 which can be selectively lowered to stabilize the vessel during ride operations. To this end, each of the hulls can include vertical openings and/or channels along the side(s) of the hulls to permit operation of the anchor system. Moreover, each of the shafts 17 can be operated manually or can be connected to hydraulic, pneumatic or electrical actuators so as to be raised and lowered automatically. Powered shallow water anchor systems and the respective components are known in the art.

In one embodiment, a support structure 18 can be secured across the top decks of each of the vessel hulls 12, 13 and 14. The support structure can function to provide an inclined surface onto which the rider section can be secured. Because the system 10 is a motor vessel that is designed to be driven along waterways, it is important that the structural support be sturdy and robust so as to accommodate forces applied during both the operation of the ride system, and torsional forces encountered during operation of the vessel itself.

In the preferred embodiment, the support structure 18 can be constructed from a plurality of corrosion resistant steel or aluminum tubular frame elements that are permanently coupled together via welds or other such connectors. Of course, other construction materials are also contemplated.

In one embodiment, the rider section can include an angled ride surface 21 that is positioned between a lower platform 22 and an upper platform 23.

In the preferred embodiment, the ride surface 21 will be constructed from a single sheet of vinyl membrane; however, any number of other well-known materials commonly used in sheet-type systems may also be used. Several nonlimiting examples include various types of plastics, foams; fiberglass, fabric bladders, inflatable bladders, and/or reinforced tension fabrics, for example, that are sufficiently smooth to minimize friction loss and will stand the surface loads involved.

In the preferred embodiment, the ride surface 21 can be a sheet-wave type system having a gradual curvature to assist in the smooth flow of water W over the surface during operation. To this end, the ride surface 21 can observe: upward concavity in longitudinal section parallel to the direction of water flow; or a longitudinal section comprised of upward concavity transitioning to an upward convexity; or a combination of straight, concave and convex longitudinal sections, among others, for example.

Although numerous shapes are possible, there must be an inclined portion of sufficient length, width and degree of angle to enable a rider(s) to perform water skimming maneuvers. For example, an incline of the rider surface 21 having an angle of 20 degrees with respect to the horizontal is suitable for use herein, when a flow of water having a depth of 3 inches and a flow rate of 32 feet per second is flowing thereover. In order to achieve flow of the specified velocity over this incline, a water volume of 100,000 gallons per minute was found to be adequate.

In one embodiment, the lower platform 22 can be positioned along the leading edge of the rider surface 21 which is located at the front end of the vessel. The lower platform can be constructed from any number of different materials such as rubber coated metal, or plastic, for example, and can include a nozzle 23 for dispensing a supercritical flow of water along the rider surface 21 that is supplied from the pumping system.

In one embodiment, the upper platform 24 can be positioned along the trailing edge of the rider surface 21 which is located at the back end of the vessel. The upper platform can also be constructed from any number of different materials such as rubber coated metal, or plastic, for example, and can include a plurality of openings 25 for discharging water exiting the rider surface 21 back onto the body of water on which the vessel is located.

In one embodiment, each of the openings may be directly open to the water body surface so as to independently channel and discharge the water thereto. In another embodiment, each of the openings can be connected to a single output funnel or other such device having an orientation that may be selectively manipulated by a vessel operator. In such an embodiment, the pump system can advantageously function to provide additional propulsion to the vessel during transport operations in either a routine or an emergency situation.

As shown, a pair of walkways 26 can be positioned along either side of the rider surface 21. The walkways may include steps or may be built as an angled surface for allowing a rider to walk between the upper and lower platforms. Each of the walkways including an inner wall **26*a* this is preferably lined with a padded material to absorb impacts from riders during operation, and an outer wall 26*b*** having a safety railing or the like to ensure the rider does not fall off of the platform.

As shown best at FIG. 2, the pump system can function to capture water from a natural body of water on which the vessel 11 is floating for use during rider operation. To this end, the pump system can include an impeller assembly 41, an engine 42, and a funnel/water pipe 44 that are connected to the above-described nozzle 23.

An impeller assembly 41 can be positioned along the bottom of the main hull 12 and can be mechanically coupled to an engine 42 by a driveshaft 43. The output section of the impeller assembly can be connected to an elongated water pipe 44 that terminates into the nozzle 23. The engine functioning to supply the mechanical force for turning the impeller blades with sufficient force to suck water from the surrounding body and forcing the same up through the pipe and through the nozzle.

In one embodiment, the engine 42 can preferably be located within the hull 12 at a location beneath the lower platform 22 and can comprise any type of inboard gasoline or diesel engine capable of driving the impeller with sufficient force to achieve a water depth of 3 inches, a flow rate of 32 feet per second, and a water volume of 100,000 gallons per minute over the rider surface 21.

In one embodiment, a 19" diameter jet drive that is connected to a 250 HP inboard motor has been found to be sufficient to produce these results. Of course, any number of other engine and impeller sizes are contemplated in order to achieve the same or different flow rates during ride operations.

FIG. 3 is a partial side cutout view of the system 10 in operation, wherein the outboard hull 13 and half of the ride section are removed for ease of illustration. As shown, the impeller 41 pushes water through the nozzle 23 and over the rider surface 21 where a rider 1 can utilize a board or other device to simulate a surfing experience. The water can be expelled from the system through the openings in the upper platform 24 and can be returned to the surrounding body of water.

In the illustrated embodiment, an optional sail 30 can be suspended from the forward vertical anchor shaft 17, and a rope 31 can be connected to the sail for assisting the user during their ride.

Accordingly, the above-described system can be driven along any number of navigable waterways until reaching an intended destination. Upon arrival, the vertical anchors can be lowered in order to stabilize the vessel, and the pump system can be activated. Because the vessel is waterborne and uses the body of water for the rider area, there is no need for onboard storage tanks and other such systems required by land-based systems.

Although dimensions are not critical, in the preferred embodiment, each of the hulls 12-14 can include a length of approximately 40'. It is also preferred that the width of the system 10 be approximately 23', so as to permit the vessel to be capable of operating on most commercially utilized rivers and waterways. Of course, any number of other dimensions are also contemplated.

As described herein, one or more elements of the self-propelled waterborne wave riding system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A wave riding system, comprising:

a vessel having functionality for floating on a body of water;

a lower platform that is positioned along a front section of the vessel;

an upper platform that is positioned along a back section of the vessel;

an elongated angled ride surface having a first end that is connected to the lower platform and a second end that is connected to the upper platform;

a horizontally-oriented nozzle that is in communication with each of the lower platform and the angled ride surface;

a pump system is configured to receive water from the body of water, and to push the received water to the nozzle; and an anchor system that is configured to stabilize the vessel during a ride operation, said anchor including a plurality of elongated shafts that are configured to extend and retract vertically from the vessel, wherein the vessel comprises a tri-hull boat.

2. The system of claim 1 further comprising:

at least one engine that is positioned along the boat and is configured to propel the boat along the body of water.

3. The system of claim 2, wherein the at least one engine includes two outboard motors that are positioned along a pair of outboard hulls of the tri-hull boat.

4. The system of claim 1, wherein the pump system comprises:

an impeller assembly that is positioned along a bottom surface of the vessel.

5. The system of claim 4, wherein the impeller assembly comprises a 19 inch jet drive.

6. The system of claim 4, further comprising:

an engine that is mechanically coupled to the impeller assembly.

7. The system of claim 6, wherein the engine is positioned within the vessel at a location beneath the lower platform.

8. The system of claim 6, wherein the engine comprises a 250 HP inboard motor.

9. The system of claim 4, further comprising:

a water pipe having a first end that is connected to the impeller assembly and a second end that is connected to the nozzle.

10. The system of claim 1, further comprising:

a sail that is communicatively linked to the anchor system.

11. The system of claim 1, wherein the rider area is a sheet-wave system.

12. The system of claim 11, wherein the rider area is constructed from a single sheet of vinyl membrane.

13. The system of claim 1, further comprising:

a support structure that is positioned between a top surface of the vessel and a bottom surface of each of the lower platform, the upper platform and the rider area.

14. The system of claim 13, wherein the support structure connects each hull of the tri-hull boat together.

15. The system of claim 1, wherein one of the plurality of elongated shafts are located in each hull of the tri-hull vessel.

16. The system of claim 1, further comprising:

a drain that is positioned along the upper platform, said drain being configured to receive water from the nozzle and the angled ride surface, and to directly deposit the received water back into the body of water.

* * * * *